US005469878A

United States Patent [19]

Pringle

[11] Patent Number: 5,469,878

[45] Date of Patent: Nov. 28, 1995

[54] COILED TUBING CONCENTRIC GAS LIFT VALVE ASSEMBLY

[75] Inventor: Ronald E. Pringle, Houston, Tex.

[73] Assignee: Camco International Inc., Houston, Tex.

[21] Appl. No.: 115,623

[22] Filed: Sep. 3, 1993

[51] Int. Cl.[6] ..... F04F 1/08

[52] U.S. Cl. ..... 137/155; 166/380

[58] Field of Search ..... 137/155; 166/77, 166/380, 325, 326, 319; 417/115

[56] References Cited

U.S. PATENT DOCUMENTS 2,248,951 7/1941 Boynton ..... 137/155
5,170,815 12/1992 Going, III et al. ..... 137/155

OTHER PUBLICATIONS

Drawing No. 02371 dated Nov. 15, 1962 by Camco, Inc. entitled "One Inch E-1 Concentric Valve".

*Primary Examiner*—Martin P. Schwadron
*Assistant Examiner*—Kevin L. Lee
*Attorney, Agent, or Firm*—Fulbright & Jaworski

[57] ABSTRACT

A flexible spoolable coiled tubing gas lift valve assembly connected in a coiled tubing. The flexible valve includes a circular housing having an axial bore therethrough for allowing the passage well tools therethrough. In one embodiment, the valve element and valve seat of the gas lift valve are eccentrically positioned in the housing. In another embodiment, the valve and valve seat are concentrically positioned in the housing. The valve element is guided and supported laterally by the housing and may include flow injection ports.

12 Claims, 6 Drawing Sheets

COILED TUBING CONCENTRIC GAS LIFT VALVE ASSEMBLY

BACKGROUND OF THE INVENTION

The present invention is directed to a coiled tubing concentric gas lift assembly which is tubing retrievable, flexible, spoolable and provides a bore therethrough allowing passage of well tools.

It is known, as disclosed in U.S. Pat. No. 5,170,815 to provide removable and flexible gas lift valves internally mounted in a coiled tubing. It is also known, as disclosed in patent application Ser. No. 08/112,038, filed Aug. 26, 1993, U.S. Pat. No. 5,427,133, entitled "Coiled Tubing Wireline Retrievable and Selective Set Gas Lift Assembly", to provide a flexible gas lift valve in a coiled tubing which can be installed and removed by wireline for allowing the passage of other well tools through the coiled tubing.

The present invention is directed to a flexible gas lift valve assembly in a coiled tubing which is positioned concentrically in the coiled tubing to provide an open bore coaxially therethrough which is in communication with the bore of the coiled tubing thereby allowing wireline work to be performed through the gas lift valves, such as bottom hole surveys including pressure and temperature measurements, without removing the gas lift valves. The present invention also provides gas lift valves in which the coaction between the valve element and valve seat is guided and supported and in which the gas lift valves may include injection ports if desired.

SUMMARY

The present invention is directed to a flexible spoolable coiled tubing gas lift valve connected in a coiled tubing having a bore. A longitudinal flexible gas lift valve includes a circular housing having first and second ends connected in a coiled tubing and the housing has an outside diameter substantially equal to the outside diameter of the coiled tubing. The housing includes an axial bore therethrough in communication with the bore of the coiled tubing for allowing the passage of well tools through the gas lift valve. The housing also includes a port between the first and second ends which extends between the inside and the outside of the housing. A movable valve element and a valve seat are provided in the housing in communication with the port and the valve element is controlled by a gas containing compartment. The valve element and the valve seat are eccentrically positioned in the housing.

Yet a further object of the present invention is wherein the housing includes a check valve eccentrically located and in communication with the valve seat.

Still a further object of the present invention is wherein seal means is provided between the movable valve element and the housing. In one embodiment the seal means is a bellows.

Still a further object of the present invention is wherein the valve element is laterally supported and guided by the housing.

A still further object of the present invention is the provision of a gas lift valve in which the valve and the valve seat are coaxially positioned in the housing and the valve element may include a plurality of injection ports positioned downstream of the valve seat.

Yet a still further object is wherein the valve element is laterally supported and guided by the housing on both sides of the valve seat.

A further object is the provision of a check valve having a plurality of openings in the housing and a circular resilient check element covering said openings and secured to the valve element.

Other and further objects, features and advantages will be apparent from the following description of presently preferred embodiments of the invention, given for the purpose of disclosure, and taken in conjunction with the accompanying drawings.

DESCRIPTION OF THE PREFERRED EMBODIMENT

Figure 1A:
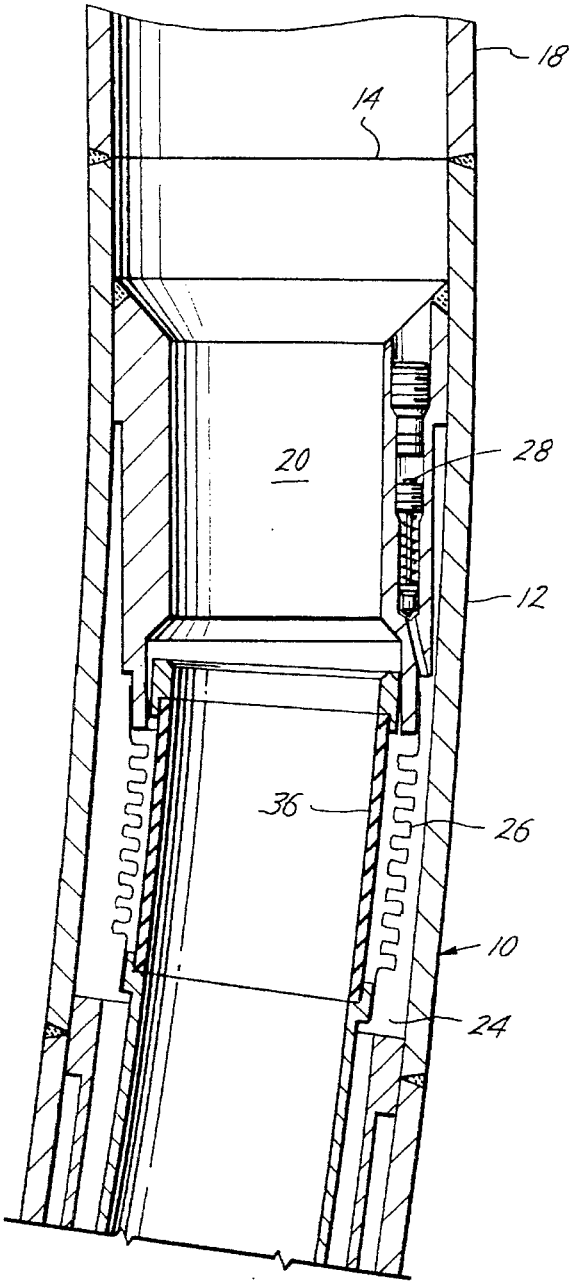
FIGS. 1A and 1B are continuations of each other and form an elevational view, in cross section, of one form of the present invention shown in the closed position and in a spooled position.

The present invention will be described as various individual types of gas lift valve assemblies for particularly pointing out the claimed invention. However, it is to be understood that each coiled tubing may include one or more of the gas lift assemblies of the present invention vertically connected in the coiled tubing and spaced from each other.

Referring now to the drawings, and particularly to FIGS. 1A and 1B, and 2A and 2B, the reference numeral 10 generally indicates the longitudinally flexible gas lift valve of the present invention which includes a circular housing 12 having a first end 14 and a second end 16 connected in a coiled tubing 18, such as by welding. Preferably, the housing 12 has an outside wall thickness and an outside diameter substantially equal to the thickness and outside diameter of the coiled tubing 18. The housing 12 also includes an axial bore 20 therethrough in communication with the bore of the coiled tubing 18 for allowing the passage of well tools through the coiled tubing 18 and the gas lift valve 10. The housing 12 also includes a port 22 for the admission of gas from the annulus around the outside of the housing 12 which is injected into the bore 20 as best indicated by the arrows in FIG. 2B for lifting fluids therein.

The gas lift valve 10 is normally biased to a closed position by a gas charged compartment 24 acting on one or more bellows 26 and 27. The gas compartment 24 is charged through a dill valve 28 such as by air or nitrogen. A movable valve element such as a ball 30 and a seat 32 are provided in the housing 12 in communication with the port 22. The gas charged compartment 24 acts to seat the valve element ball 30 on the seat 32 by being connected to a valve element extension 34. For opening the valve 10, lifting gas is injected into the port 22, acts on the exterior of the bellows 27 to contract the bellows 27, lifts the ball valve element 30 and allows the gas to pass through the valve seat 32 into the bore 20.

Figure 1B:
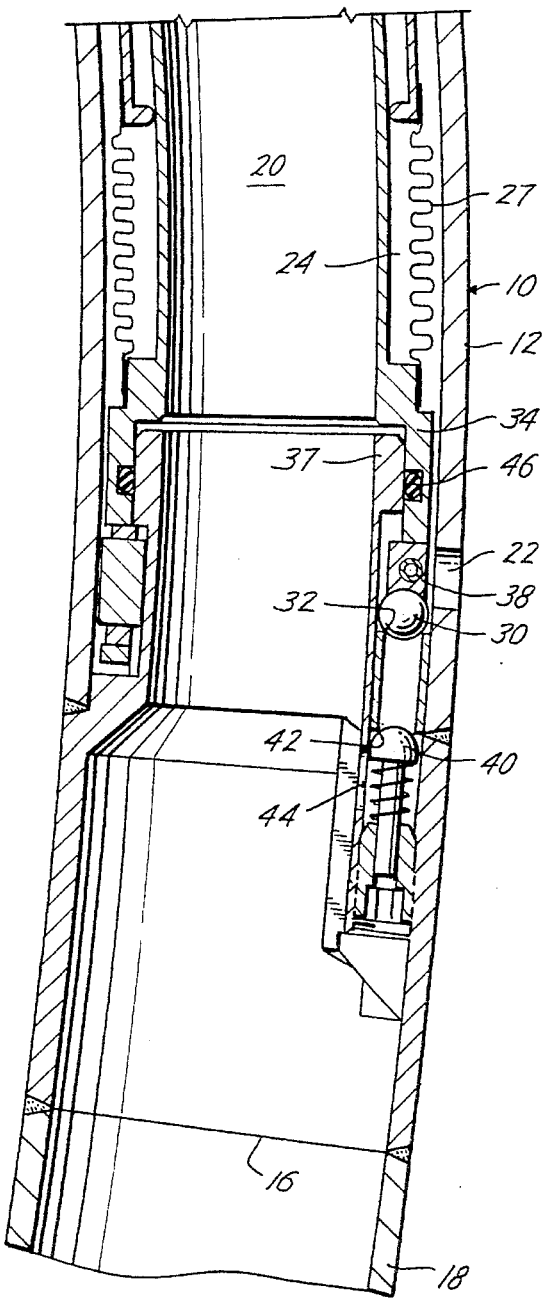

The valve 10 is advantageous in that it is longitudinally flexible and spoolable and is shown in the spooled position in FIGS. 1A and 1B. The valve 10 is flexible in that the housing 12 may bend, and, of course, the bellows 26 and 27 are longitudinally flexible. A flexible wire mesh 36 is provided adjacent the bellows 26 which may be a rubber flexible wire mesh for protecting the bellows 26 from fluids in the bore 20 but still allow longitudinal flexibility. Also, the housing 12 of the valve 10 is concentric providing a large axial bore 20 therethrough for allowing wireline work to be performed through the coiled tubing 18 and gas lift valves 10 as well as providing maximal flow area in the coiled tubing string.

Figure 5:
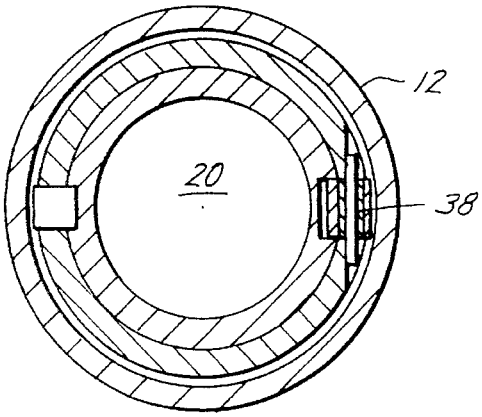
FIG. 5 is a cross-sectional view taken along the line 5—5 of FIG. 2B.
Figure 6:
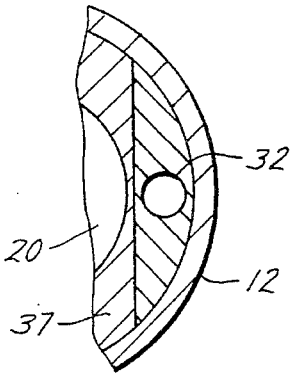
FIG. 6 is a fragmentary view taken along the line 6—6 of FIG. 2B.

Prior art concentric valve elements and valve seats have been proposed in the past but they resulted in erratic valve operation because the ratio of the operating bellows effective area to the injection port size of the valve could not be maintained because of excessive wear and misalignment between the valve stem and seat. The present invention overcomes this problem by moving the valve element 32 and the valve seat 34 off of the center line of the valve 10 and eccentrically mounting them within the valve housing 12. In addition, it is noted that the valve element extension 34 is slidable against an inner wall 36 of the valve housing 12 thereby providing guidance and support for the valve element 30 which is supported from a roll pin 38 (FIGS. 1B and 5) to provide a floating valve element which sealably mounts on the valve seat 32.

A check valve 40, preferably spring loaded, is provided in the housing 12 eccentrically located and in communication with the valve seat 32 for normally seating on a seat 42 preventing tubing fluids from flowing out through an opening 44 and though the port 22 but allowing the reverse flow of gas lift fluids.

Figure 2A:
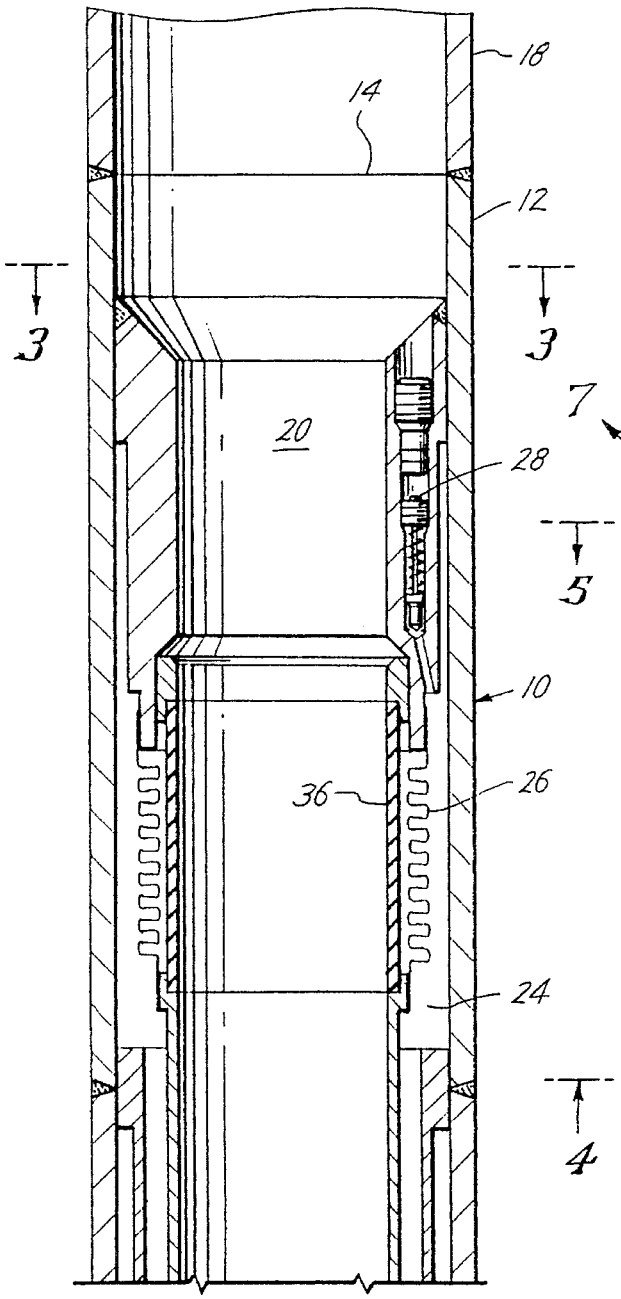
FIGS. 2A and 2B are continuations of each other and form an elevational view, in cross section, of the gas lift valve of FIGS. 1A and 1B but shown in an open position.
Figure 2B:
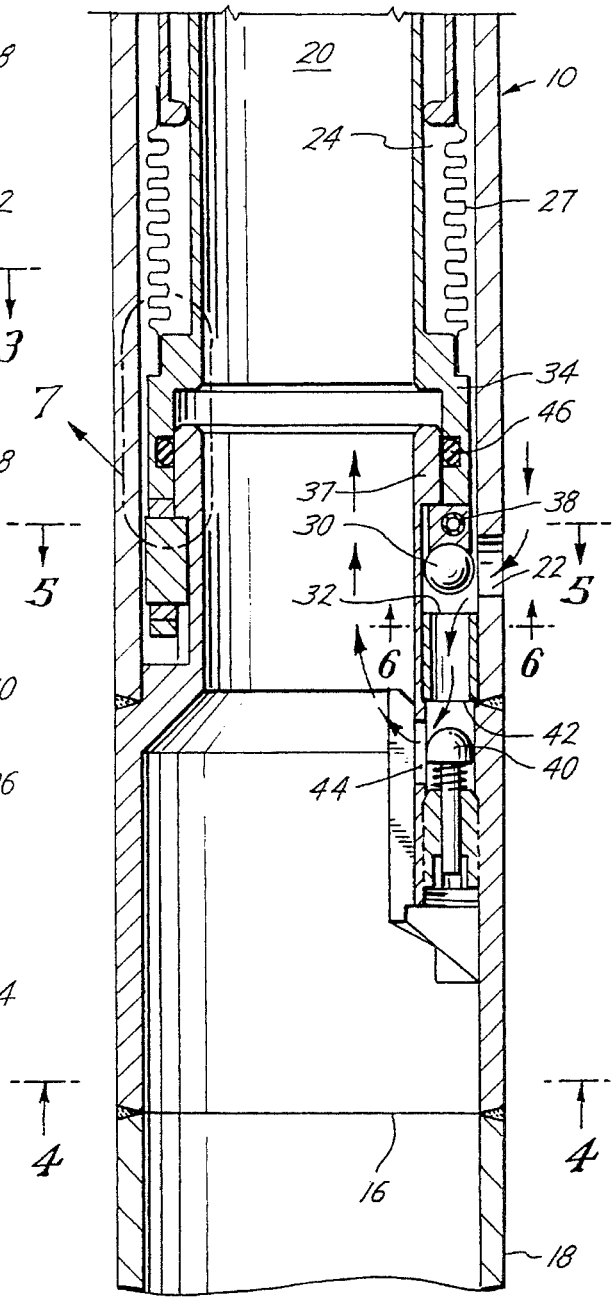
Figure 3:
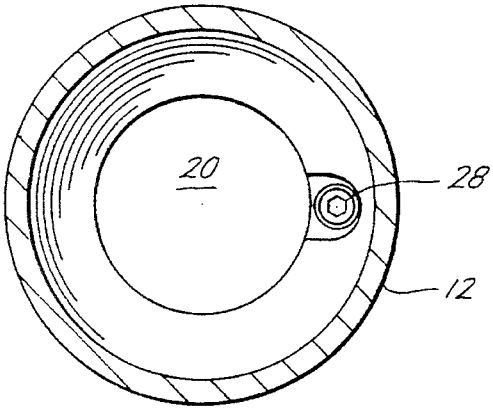
FIG. 3 is a cross-sectional view taken along the line 3—3 of FIG. 2A.
Figure 4:
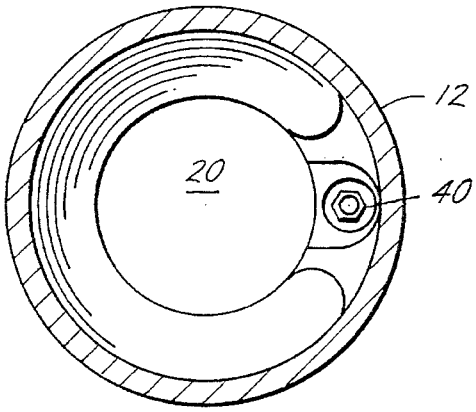
FIG. 4 is a cross-sectional view taken along the line 4—4 of FIG. 2B.
Figure 7:
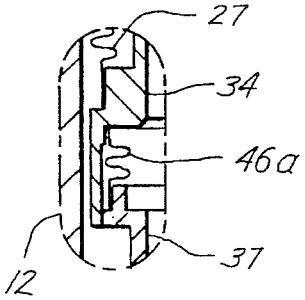
FIG. 7 is an alternate embodiment of seal means positioned in the oval of FIG. 2B, FIGS. 8A and 8B are continuations of each other and form an elevational view, in cross section, of another form of the present invention shown in the closed position and in a spoolable position.

Referring to FIGS. 1B and 2B, a seal 46 is provided between the valve element extension 34 and the inner wall 36 of the housing. In some cases, the effective diameter of the seal 46 may be made equal to the effective mean diameter of the bellows 26 for balancing out the effect of tubing pressure in the bore 20, while in other cases, the diameter of the seal 46 may be varied depending upon the desirability of obtaining effective action of the tubing pressure on the bellows. While the seal 46 shown in FIGS. 1B and 2B is a conventional resilient seal, in another embodiment, as best seen in FIG. 7, the seal **46*a*** may be a bellows.

In FIGS. 1A and 1B, the valve 10 is shown spooled upon a coiled tubing reel (not shown) and in the closed position. In FIGS. 2A and 2B, the coiled tubing and valve is shown in a position in a well and in the open position in which lift gas is being injected through the valve 10 and upwardly through the bore 20.

Other and further embodiments will be further described wherein like parts to those numbered in FIGS. 1A through 7 will be similarly numbered with the addition of the suffix "a".

Figure 8A:
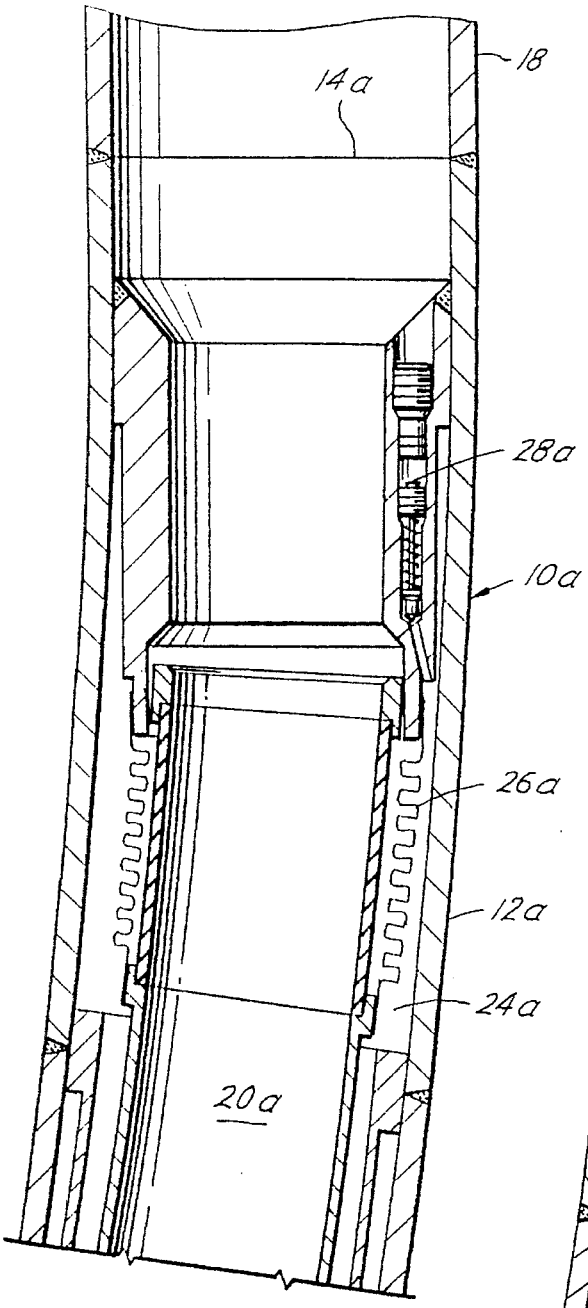
Figure 8B:
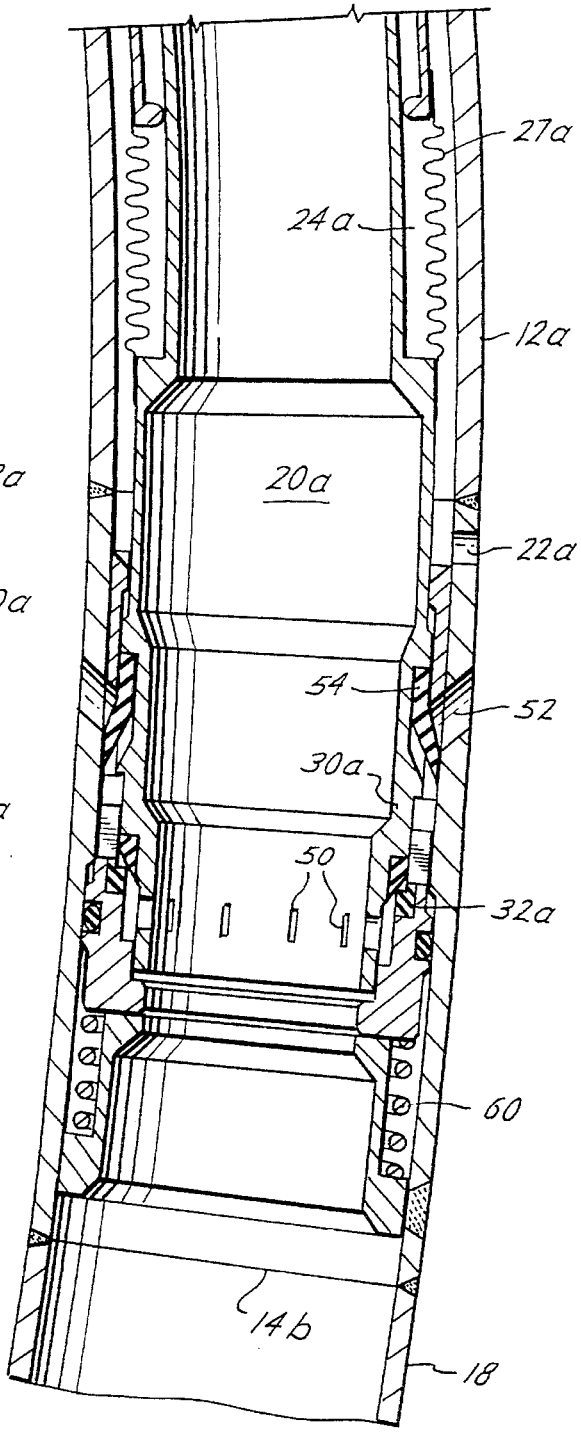
Figure 9A:
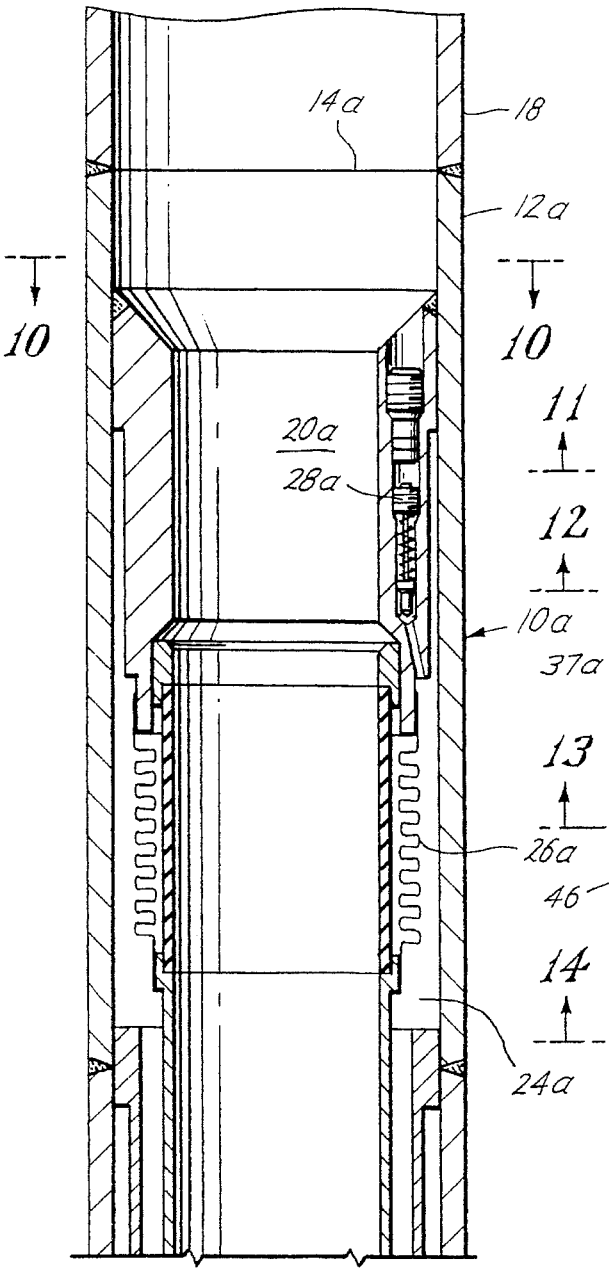
FIGS. 9A and 9B are continuations of each other and form an elevational view, in cross section, of FIGS. 8A and 8B but in the open and unspooled position.
Figure 9B:
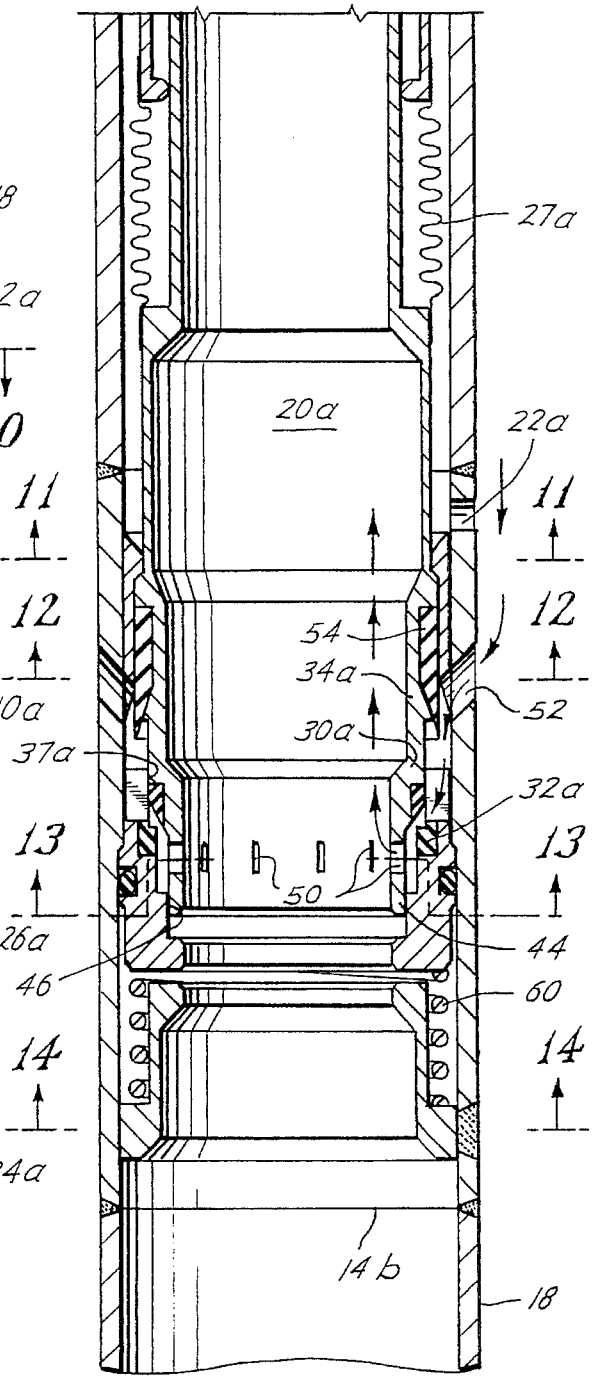
Figure 10:
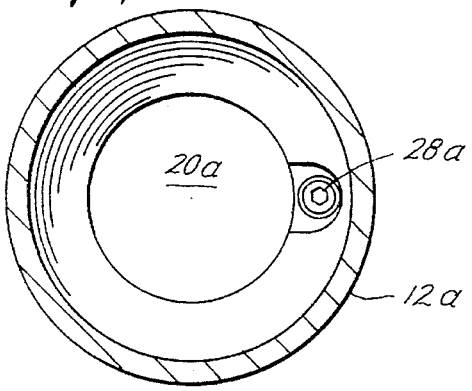
FIG. 10 is a cross-sectional view taken along the line 10—10 of FIG. 9A.
Figure 11:
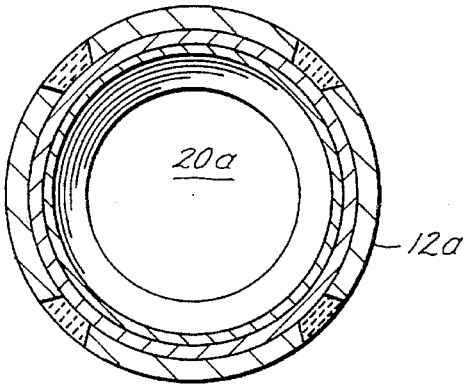
FIG. 11 is a cross-sectional view taken along the line 11—11 of FIG. 9B.
Figure 12:
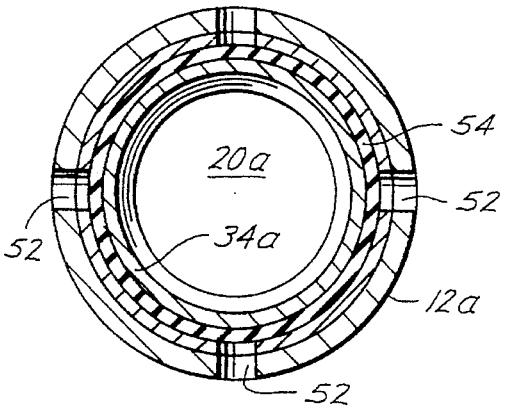
FIG. 12 is a cross-sectional view taken along the line 12—12 of FIG. 9B.
Figure 13:
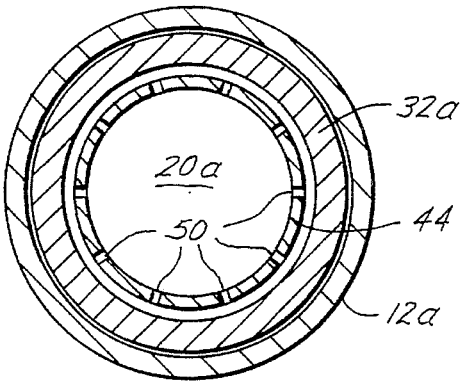
FIG. 13 is a cross-sectional view taken along the line 13—13 of FIG. 9B.
Figure 14:
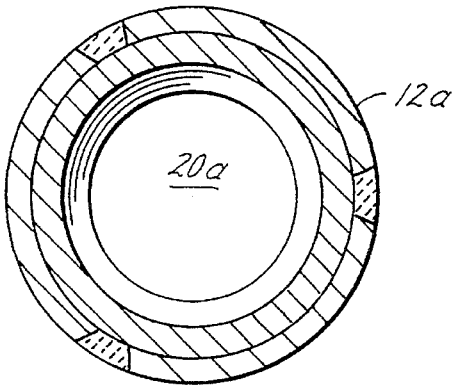
FIG. 14 is a cross-sectional view taken along the line 14—14 of FIG. 9B.

The valve **10*a*, shown in the closed and spooled position in FIGS. 8A and 8B and in the open and extended position in FIGS. 9A and 9B includes a housing 12*a* secured in a coiled tubing 18 having an axial bore 20*a* therethrough. A gas compartment 24*a* acts against bellows 26*a* and 27*a* to normally bias a concentric valve element 30*a* onto a concentric seat 32*a*. The housing 12*a* includes a port or ports 22*a* for admitting gas from the annulus around the housing 12*a* to act on the bellows 27*a* in a direction for retracting the valve element 30*a* from the valve seat 32*a*. First, it is noted that the valve 10*a*, unlike the valve 10 in which the valve element 30 in valve seat 32 were eccentrically positioned in the housing 12, contains a concentric valve element 30*a* and concentric valve seat 32*a*. However, the valve stem, unlike prior art concentric valves, is guided and laterally supported at two places for overcoming the problems of prior art valves. Thus, the valve element 30*a* includes a valve element extension 34*a* which engages an inner wall 36*a* at a position above the valve seat 32*a*. In addition, the valve element 30*a* includes a lower extension 44 which engages a housing lower guide 46 which is positioned below the valve seat 32*a*. Thus, as the valve element 30*a* moves, it is laterally supported and guided, both above and below the valve seat 32*a*, thereby ensuring accurate and aligned mating of the valve element 30*a* with the valve seat 32*a***.

Thus, while the valve **10*a*** is concentric, it is securely centralized to provide a good mating relationship between the valve element and valve seat.

Valve **10*a* also includes a spring 60 acting against the movable valve seat 32*a*** which helps bias the valve to a closed position.

It is also to be noted, that, if desired, the lower extension 44 includes a plurality of injection ports 50 which, when the valve is in the open position, as best seen in FIG. 9B, regulates the injection pressure flowing into the bore.

Valve **10*a* also includes a check valve which includes a plurality of ports 52 in the housing 12*a* and a circular resilient check element 54 secured to the valve element 30*a*. When the valve 30*a* is closed, as best seen in FIG. 8B, the resilient check valve 54 covers and closes the ports 52. However, when the valve 30*a* is moved to the open position, the resilient check 54, which includes a lower tapered end, allows inward passage of gas through the ports 52, through the valve seat 32*a*, and out the injection pressure ports 50**.

The valve **10*a* is also flexible, similar to the valve 10, and in addition, has a maximum flow area bore 20*a*** which allows wireline work to be performed therethrough without removing the valves.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts, will readily suggest themselves to those skilled in the art and which are encompassed within the spirit of the invention and the scope of the appended claims.

What is claimed is:

1. A flexible spoolable coiled tubing gas lift valve connected in a coiled tubing having a bore comprising, a longitudinally flexible gas lift valve having a circular housing having first and second ends connected in a coiled tubing, said housing having an outside diameter substantially equal to the outside diameter of the coiled tubing and an inside diameter substantially equal to the inside diameter of the coiled tubing, said housing having an axial bore therethrough in coaxial communication with the bore of the coiled tubing for allowing the passage of well tools through the gas lift valve, said housing having a port between the first and second ends and extending between the inside and the outside of the housing, said housing having a movable valve element and a valve seat in communication with the port, said valve element controlled by a gas containing compartment, and said valve element and said valve seat being eccentrically positioned within the inside diameter of the housing.

2. The gas lift valve of claim 1 wherein the housing includes a check valve eccentrically located and in communication with the valve seat.

3. The gas lift valve of claim 1 including, seal means between the movable valve element and the housing.

4. The gas lift valve of claim 3 wherein the seal means is a bellows.

5. The gas lift valve of claim 1 wherein the valve element is laterally supported and guided by the housing.

6. A flexible spoolable coiled tubing gas lift valve connected in a coiled tubing having a bore comprising, a longitudinally flexible gas lift valve having a circular housing having first and second ends connected in a coiled tubing, said housing having an outside diameter substantially equal to the outside diameter of the coiled tubing, and said housing having an axial bore therethrough in communication with the bore of the coiled tubing for allowing the passage of well tools through the gas lift valve, said housing having at least one port between the first and second ends extending between the inside and the outside of the housing, and said housing including a movable valve element and a valve seat, said valve element controlled by a gas containing compartment, said valve and said valve seat being coaxially positioned in the housing and said valve element including a plurality of injection ports positioned downstream of the valve seat.

7. The gas lift valve of claim 6 wherein the valve element is laterally supported and guided by the housing.

8. The gas lift valve of claim 6 wherein the valve element is laterally supported and guided by the housing on both sides of the valve seat.

9. The gas lift valve of claim 6 including, a check valve having a plurality of openings in the housing and a circular resilient check element covering said openings and secured to the valve element.

10. A flexible spoolable coiled tubing gas lift valve connected in a coiled tubing having a bore comprising, a longitudinally flexible gas lift valve having a circular housing having first and second ends connected in a coiled tubing, said housing having an outside diameter substantially equal to the outside diameter of the coiled tubing, and said housing having an axial bore therethrough in communication with the bore of the coiled tubing for allowing the passage of well tools through the gas lift valve, said housing having at least one port between the first and second ends extending between the inside and the outside of the housing, said housing including a movable valve element and a valve seat, said valve element controlled by a gas containing compartment, said valve and said valve seat being coaxially positioned in the housing, and said valve element is laterally supported and guided by the housing.

11. The gas lift valve of claim 10 wherein the valve element is laterally supported and guided by the housing on both sides of the valve seat.

12. A flexible spoolable coiled gas lift valve connected in a coiled tubing having a bore comprising, a longitudinally flexible gas lift valve having a circular housing have first and second ends connected in a coiled tubing, said housing including an outside diameter substantially equal to the outside diameter of the coiled tubing, and an inside diameter substantially equal to the inside diameter of the coiled tubing, and said housing having an axial bore therethrough in coaxial communication with the bore of the coiled tubing for allowing the passage of well tools through the gas lift valve, said housing having at least one port between the first and second ends extending between the inside and outside of the housing, said housing including a movable valve element and a valve seat, said valve element controlled by a gas containing compartment, said valve seat and said valve element being positioned within the inside diameter of the housing, and said valve element is laterally supported and guided by the inside diameter of the housing.

* * * * *